United States Patent [19]

Cooke

[11] 4,100,547

[45] Jul. 11, 1978

[54] FLUORESCENT TUBE INDICATOR MOUNTED ON ANTENNA

[75] Inventor: P. Richard Cooke, Yonkers, N.Y.

[73] Assignee: Midnight Ears, Inc., White Plains, N.Y.

[21] Appl. No.: 690,251

[22] Filed: May 26, 1976

[51] Int. Cl.[2] ..... H01Q 1/06

[52] U.S. Cl. ..... 343/721; 343/894

[58] Field of Search ..... 343/720, 721, 760, 894

[56] References Cited

U.S. PATENT DOCUMENTS

| | | | |
|---|---|---|---|
| 1,911,234 | 5/1933 | Meyer | 343/823 |
| 2,744,189 | 5/1956 | Wudyka | 343/721 |

OTHER PUBLICATIONS

Air Force Manual 52-8; Dec. 1960, pp. 9-23.

*Primary Examiner*—Eli Lieberman
*Attorney, Agent, or Firm*—Joseph Levinson

[57] ABSTRACT

A transmitter antenna attachment is provided having a pair of L-shaped brackets of insulating material for attaching a fluorescent lamp on the antenna of a transmitter which lights when the transmitter is actuated. The fluorescent lamp is mounted in hollow sockets on one extremity of the brackets, with the other extremity of the brackets having openings therein which are adapted to receive and mount the lamp on an antenna wire.

5 Claims, 3 Drawing Figures

FLUORESCENT TUBE INDICATOR MOUNTED ON ANTENNA

BACKGROUND OF THE INVENTION

This invention relates to a transmitter antenna attachment, and more particularly to an attachment containing a fluorescent lamp which is mounted on a transmitter antenna and lights when the transmitter is activated.

Citizen band radios have become immensely popular, and are being installed on thousands of vehicles around the country. Although most such units have indicator lights indicating that the system is on, the operator will have no assurance that he is transmitting with sufficient power unless he receives an answer to his transmission. It would be desirable to provide a very simple and inexpensive means for indicating that the transmitter is operating properly without providing elaborate electrical circuitry for this purpose and without utilizing the power supplies of the vehicle for such purpose. It would also be desirable to provide such an indicator which would add a decorative touch to an otherwise unattractive antenna.

Accordingly, it is an object of this invention to provide a new and novel transmitter antenna attachment which is simple to attach to the antenna, and which is relatively inexpensive.

A further object of this invention is to provide a novel transmitter antenna attachment in the form of a fluorescent lamp which is illuminated when the transmitter is activated without utilizing a direct source of power from the motor vehicle on which it is mounted.

Still another object of this invention is to provide a transmitter antenna attachment which adds a decorative touch to an otherwise unattractive antenna.

SUMMARY OF THE INVENTION

In carrying out this invention in one illustrative embodiment thereof, the transmitter antenna attachment is provided having a pair of L-shaped brackets of insulating material with hollow sockets on one extremity thereof which house a fluorescent lamp by frictional engagement therewith. Openings are provided on the other extremity of the L-shaped brackets for mounting the lamp on the antenna wire with the lamp being activated by the energy radiated by the antenna when the transmitter is activated.

DESCRIPTION OF THE PREFERRED EMBODIMENTS

Figure 1:
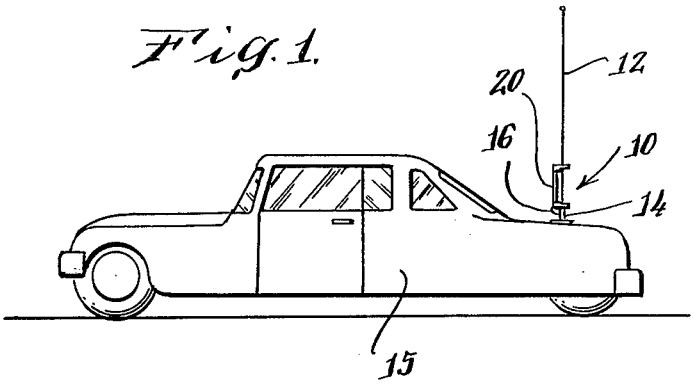
FIG. 1 shows the novel transmitter antenna attachment embodied in the present invention mounted on a motor vehicle.

Referring now to FIG. 1, a transmitter antenna attachment, referred to generally with the reference character 10, is attached to an antenna wire 12 which is secured by an antenna base 14 to a motor vehicle 15. A grounding wire 16 may be connected between the attachment 10 and the antenna ground.

Figure 2:
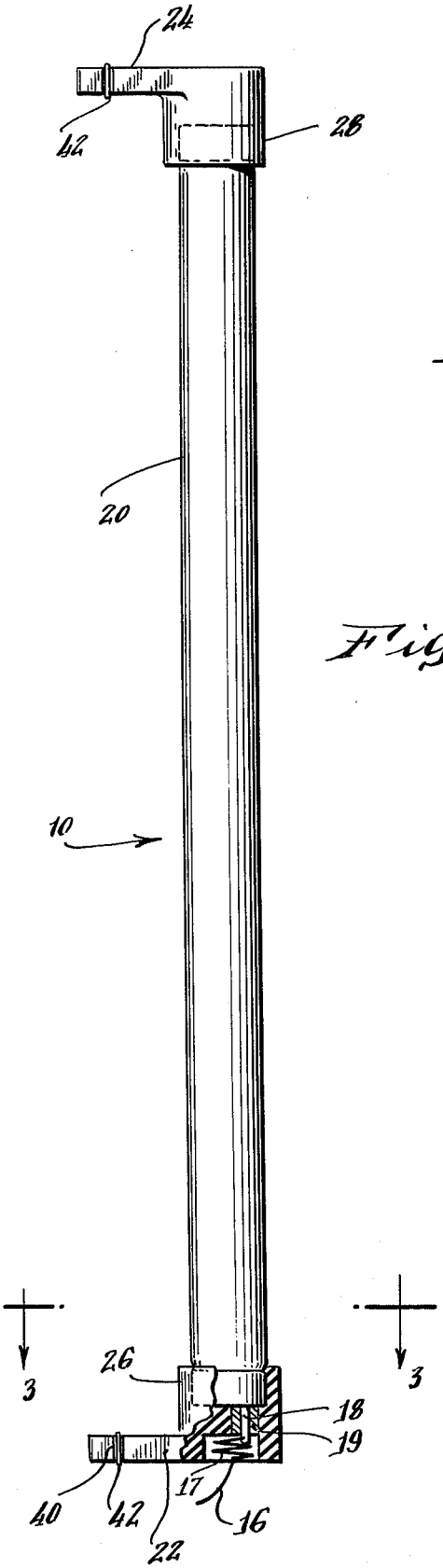
FIG. 2 is a side view of the transmitter antenna attachment shown in FIG. 1.
Figure 3:
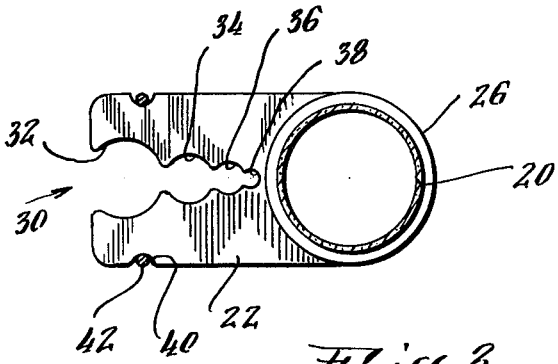
FIG. 3 is a sectional view of the transmitter antenna attachment taken along line 3—3 of FIG. 2.

As will best be seen in FIGS. 2 and 3, the attachment 10 is comprised of a pair of L-shaped brackets 22 and 24, having a fluorescent lamp 20 mounted therein. The brackets 22 and 24 are made of a suitable insulating material, which may be injection molded, such as polypropylene, and have sockets 26 and 28 in one extremity of the brackets 22 and 24, respectively. The sockets 26 and 28 are merely openings in the brackets 22 and 24 respectively, which are adapted to receive and frictionally engage the ends of the fluorescent lamp 20, and to hold it therebetween. The other extremity of the brackets 22 and 24 have openings 30 therein which are adpated to receive and frictionally engage the antenna 12. The openings 30 are characterized by a generally spherical configuration with a plurality of channels 32, 34, 36 and 38, which are progressively smaller in diameter in order to accommodate different diameters of antennas. The extremities of the brackets 22 and 24 containing the openings 30 have sufficient resiliency to snap or clip on the antenna 12. However, to insure firm mountings, an indentation 40 is provided around the outer circumference of the brackets 22 and 24 to accommodate an O-ring clip which may be utilized to clamp the antenna attachment 10 to the antenna 12 to insure that the attachment 10 will not fall off regardless of the speed at which the motor vehicle is traveling.

As previously stated, a grounding wire 16 may be provided, which is connected to a terminal 19 in one of the brackets, which is illustrated in the drawings as bracket 22. A pick-up coil 17 may also be provided which is coupled between the grounding wire 16 and the terminal 19. One of the pins 18 of the fluorescent lamp 20 is inserted into the terminal 19 when mounting the fluorescent lamp 20 into the brackets 22 and 24. The pick-up coil 17 and the grounding wire reduce the output required for lighting the lamp 20. The grounding wire and/or coil 17 may not be required if the output of the antenna is sufficient to ionize the gases of the fluorescent lamp 20. However, on less expensive sets with lower outputs, the coil 17 and the grounding wire 16 may be utilized to lower the wattage requirement for illuminating the fluorescent lamp 20.

The typical citizens band radio has an output of approximately 4 watts, which is more than adequate to fluoresce the lamp 20. The length of the lamp to be employed will depend on the particular application, but lamps from 6 inches to 12 inches rated at 4 to 8 watts are preferable for the present application. Using the pick-up coil 17 and grounding wire 16 on the attachment will generally lower the wattage requirements of the citizen band transmitter to 2 watts and above. The openings 30 in the brackets 22 and 24, which are adapted to receive the antenna wire will preferably range in diameter from five-sixteenths to one-eighth inch to accommodate different sized antennna wires.

Assembling the transmitter antenna attachment merely requires positioning the bracket 22 on one end of the fluorescent lamp 20, with the lamp being positioned frictionally engaging the opening or socket 26 in the bracket 22. The other bracket 24 is slipped over the other end of the fluorescent lamp 20, with the lamp being positioned frictionally engaged in the opening 28 of the bracket 24. If a grounding wire and/or pick-up coil is desired and utilized, one pin 18 of the lamp 20 engages the terminal 19 in the socket 26 as shown in FIG. 2. The attachment then is positioned on the antenna with the antenna 12 being placed in the openings 30 at the end of the brackets 22 and 24, and is then clamped thereon by slipping O-rings 42 over the ends of the brackets 22 and 24 in the indentations 40. The ground wire 16 is then connected to the base or ground 14 of the antenna 12.

In operation, when the transmitter of the citizens band radio is activated, the energy radiated from the antenna ionizes the gases in the fluorescent lamp 20, causing illumination of the lamp 20, and providing an indication that the transmitter is working properly. The lamp 20 provides an an attractive attachment for the antenna, and produces a decorative effect when illuminated thereon. The attachment 10 is preferably positioned so that the operator of the motor vehicle can see it. However, the universal mounting which has been provided will accommodate the mounting of the attachment 10 at various positions along any antenna system in accordance with the desires of the operator. The attachment 10 may be connected to top, center, or base loaded antennas. Although the invention has been described in connection with use in citizen band radios, it will be apparent that the attachment is suitable for use with any transmitter which has sufficient output to cause the lamp 20 to fluoresce and become illuminated. Although not primarily designed or used as a safety light, the fact that a source of illumination is utilized will provide oncoming motorist with a visual indication of an approaching vehicle when the lamp 20 is illuminated. The transmitter antenna attachment embodied in the invention is simple to install, and since it is not attached to any other circuitry in the automobile or the transmitter, nor does it rely for its energy upon the power supplies provided by the motor vehicle, there are no safety hazards involved with the use of the attachment. Likewise, since it is not connected with the power supply of the motor vehicle, no drain is put upon such supplies by the attachment. Although standard fluorescent lamps may be used, the invention is also applicable to special lamps which do not require standard contact pins on both ends.

Since other modifications, varied to fit particular operating requirements and environments, will be apparent to those skilled in the art, the invention is not considered limited to the examples chosen for purposes of disclosure, and covers all changes and modifications which do not constitute departures from the true spirit and scope of this invention.

What I claim as new and desire to secure by letters patent is:

1. A transmitter antenna attachment for attaching a fluorescent lamp on the antenna of a transmitter which lights when said transmitter is activated, comprising in combination (a) a fluorescent lamp, and (b) a pair of L-shaped brackets of insulating material having hollow sockets on one extremity thereof adapted when the hollow sockets are positioned facing each other to receive and frictionally engage the ends of said fluorescent lamp for mounting said fluorescent lamp therein between said brackets, (c) said pair of L-shaped brackets having an opening in the other extremity thereof which are adapted to receive and frictionally engage a transmitter antenna wire for mounting said fluorescent lamp on opposite ends thereof on and substantially parallel to the antenna wire, said lamp being activated by the energy radiated by said antenna wire when the transmitter is activated.

2. The transmitter antenna attachment set forth in claim 1 wherein one of said hollow sockets has a ground wire which is coupled to the end of said lamp when said lamp is inserted in said socket, said ground wire adapted to be connected to ground to reduce the energy required to light said lamp.

3. The transmitter antenna attachment set forth in claim 1 wherein said openings in the other extremity of said L-shaped brackets are spherical and progressively smaller in order to accommodate different diameter antennas.

4. The transmitter antenna attachment set forth in claim 3 wherein said openings in the other extremity of said brackets are surrounded by an indentation which is adapted to receive an O-ring for insuring that said lamps will not fall from said antenna.

5. The transmitter antenna attachment set forth in claim 1 wherein one of said hollow sockets includes a pick-up coil which is coupled to the end of said lamp when said lamp is inserted in said socket.

* * * * *